United States Patent [19]

Dahlgren

[11] 4,208,963

[45] Jun. 24, 1980

[54] NEWSPAPER PRINTING SYSTEM

[75] Inventor: Harold P. Dahlgren, Dallas, Tex.

[73] Assignee: Dahlgren Manufacturing Company, Dallas, Tex.

[21] Appl. No.: 909,184

[22] Filed: May 24, 1978

Related U.S. Application Data

[63] Continuation-in-part of Ser. No. 897,262, Apr. 18, 1978.

[51] Int. Cl.[2] ..... B41F 7/26; B41F 7/36; B41F 7/40; B41L 25/14

[52] U.S. Cl. ..... 101/141; 101/148; 101/220; 101/351; 101/363

[58] Field of Search ..... 101/148, 179, 350, 351, 101/352, 363, 364, 136, 138, 139, 140, 141, 145, 206–209, 220, 229; 118/258, 259, 262

[56] References Cited

U.S. PATENT DOCUMENTS

| | | | |
|---|---|---|---|
| 3,283,712 | 11/1966 | Chambon | 101/350 |
| 3,508,489 | 4/1970 | Norton | 101/148 |
| 3,585,932 | 6/1971 | Granger | 101/350 |
| 3,587,460 | 6/1971 | Chambon | 101/350 X |
| 3,673,959 | 7/1972 | Jezuit et al. | 101/148 |
| 3,785,285 | 1/1974 | Chambon | 101/350X |
| 3,926,114 | 12/1975 | Matuschke | 101/148 X |
| 3,937,141 | 2/1976 | Dahlgren | 101/148 |
| 3,986,452 | 10/1976 | Dahlgren | 101/148 |
| 4,127,067 | 11/1978 | Dahlgren et al. | 101/148 X |

FOREIGN PATENT DOCUMENTS

| | | | |
|---|---|---|---|
| 938832 | 12/1973 | Canada | 101/148 |
| 224222 | 9/1925 | United Kingdom | 101/141 |

*Primary Examiner*—J. Reed Fisher

*Attorney, Agent, or Firm*—Gerald G. Crutsinger; John F. Booth; Harry C. Post, III

[57] ABSTRACT

A newspaper printing system wherein low viscosity newsprint ink and dampening fluid are applied to opposed lithographic printing plates which simultaneously engage opposite sides of a web of porous absorbent newsprint to print on both sides of the web. Each of the inkers comprises an ink metering roller in pressure indented relation with an ink transfer roller having an oleophillic surface, the ink transfer roller being in pressure indented relationship with a single form roller which is in pressure indented relation with one of the printing plates. Each of the dampeners comprises a dampening fluid metering roller in pressure indented relation with a dampening fluid transfer roller having a hydrophilic surface, the dampening fluid transfer roller being in pressure indented relation with the same single form roller such that ink and dampening fluid continuously applied on the single form roller is applied to each of the printing plates.

13 Claims, 6 Drawing Figures

NEWSPAPER PRINTING SYSTEM

CROSS-REFERENCE TO RELATED APPLICATIONS

This is a continuation-in-part of my co-pending application Ser. No. 897,262 filed Apr. 18, 1978, entitled "INKER FOR APPLYING NEWSPRINT TYPE INK".

BACKGROUND OF THE INVENTION

The newspaper printing system disclosed and claimed in this application relates to improvements in printing presses of the type disclosed in my Canadian Pat. No. 938,832 issued Dec. 25, 1973 and relates specifically to simplifying existing lithographic printing processes for publishing newspapers, books and the like on coarse, rough, absorbent pulp paper. Newsprint type paper is very coarse having a large amount of loose fibers on the surface of the paper.

Heretofore, attempts to achieve quality printing on both sides of a web have utilized opposed offset blankets mounted on cylinders. The blankets accumulate ink and tend to collect loose fibers and lint and thereby has been limited in use on newsprint paper because of the accumulation of ink and lint on the blankets and in the inking train necessitating cleaning of the blankets on the blanket cylinders.

Heretofore, presses which have attempted to print directly on both sides of newsprint, as disclosed in Canadian Pat. No. 938,832 and U.S. Pat. No. 926,102 have utilized conventional inkers.

Conventional inkers for lithographic printing plates used for printing on newsprint which have achieved "commercial" acceptance generally comprise from two to four form rollers which are positioned in rolling engagement with the printing plate. Each of the form rollers is usually in rolling engagement with one or more vibrator rollers to which ink is applied by several rollers in a train of rollers of varying diameters arranged in pyramid fashion. Ink is delivered to the train of rollers over a ductor roller which oscillates into and out of engagement with a film of ink formed by a doctor blade urged into engagement with the hard surface on an ink fountain roller by numerous ink keys.

The ink film formed on the ink fountain roller has been too thick and too irregular for application directly to a printing plate for quality printing. These inkers which include a multiplicity of rollers are intended to reduce the thickness of the ink film and to deliver a film of uniform thickness to the printing plate. However, since the ink film on each of the rollers is not totally replenished on each revolution of the form roller; image ghosting and ink accumulation and starvation is not completely eliminated. Thus, streaks and uneven ink distributions are produced on the product due to the ghosting and ink accumulation and/or starvation.

The multiple form roller, conventional inkers require complex drive trains and are relatively expensive to purchase initially and to maintain thereafter.

Other types of inkers which have attempted to meter ink from a transfer roller to a form roller have utilized a doctor blade to remove all of the film of feedback ink from the form roller prior to replenishing the ink film. Since most form rollers are resilient, the contact of the doctor blade to the form roller surface may score the form roller and wear out the blade and roller causing an uneven film of ink.

The invention described herein addresses the problem of direct printing with opposed plates engaging opposite side of a web of newsprint simultaneously without the use of offset blankets by utilizing inkers which control accumulation of ink and dampening fluid to control accumulation of lint, while eliminating the conventional train of rollers in the inking system, eliminating the necessity for the consumption of excessive power and further reducing and eliminating numerous adjustments and areas of ghosting and ink accumulation and starvation which produce undesirable variations on the product being printed.

Devices of the type disclosed in U.S. Pat. No. 3,926,114 were devised to remove all the unused portion of ink and dampening fluid from the form roller prior to forming a new film of ink by metering the ink between the form roller and a transfer roller. There may be considerable wear on the ink removal blade and the roller in this type of device. Also, it is extremely difficult to form an ink film which is sufficiently thin by using a doctor blade when metering newsprint ink.

Inking devices of the type disclosed in U.S. Pat. No. 2,240,762 employ rollers having cavities formed in the surface to meter ink onto a form roller for application to a printing plate.

An improved inker and dampener structure is described herein for applying a controlled film of ink to both sides of newsprint by direct lithography as the web of newsprint moves directly between two opposing lithographic plates. The inker and dampener cooperate together on a single form roller to eliminate excessive accumulation of ink and dampening fluid to eliminate accumulation of lint and fiber on the plate or inking and dampening system.

A pair of opposing plates simulatenously engage opposite sides of a newsprint web to print thereon. Substantially identical inkers and dampeners apply ink and dampening fluid to each opposing plate as hereinafter described.

SUMMARY OF THE INVENTION

The inker comprises a metering roller and a transfer roller, each having an oleophillic surface urged into pressure indented relationship. The metering roller and transfer roller are adapted to meter an excess of low viscosity ink at the nip between the metering roller and the transfer roller such that a substantially uniform quantity of ink is metered onto the surface of the transfer roller. An ink storage roller may be positioned in pressure relation with the transfer roller to further condition the quantity of ink to assure that the quantity of ink is substantially uniform and continuous. The quantity of ink is then sheared and metered at a nip between the transfer roller and a single inking form roller. By controlling the speed between the form roller and the transfer roller, slippage occurs thus forming a thin, substantially uniform, calendared, smooth layer of ink on the single inking form roller.

The film of ink supplied to the single inking form roller is further conditioned by a material conditioning roller to produce a smooth matte finish thereon. The material conditioning roller has essentially the same affinity for ink as does the form roller and thus splits the film to form a matte finish on the ink layer.

The matte finish is readily adapted to accepting dampening fluid for use in a lithographic printing system. A dampening system having a transfer roller with a hydrophillic surface and in pressure indented relation with a resiliently covered metering roller transfers dampening fluid to the matte finish of the ink on the form roller prior to movement of the ink and dampening fluid layer into engagement with the lithographic printing plate. The ink and water film is transferred to image areas on the printing plate and the dampening fluid only to non-image areas such that lithographic printing is performed.

After the layer of ink on the form roll moves away from the printing plate there will be ghosted or depleted areas of ink which are reduced by an ink storage roller which accumulates ink and supplies it to the ghosted or areas starved of ink prior to the layer of ink moving into the nip between the form roller and the transfer roller to more fully replenish the depleted film of ink.

As an irregular film of ink moves from the ink storage rollers on the single inking form roller, it marries again with a fresh uniform quantity of ink on the transfer roller to form a substantially uniform film of ink on the form roller by removing ink from the transfer roller to replenish the depleted areas on the form roller. The transfer roller continuously furnishes a uniform quantity of ink to the form roller and the irregular feedback film, remaining on the transfer roller as the form roller removes ink from the transfer roller, moves back to the flooded nip between the transfer roller and metering roller to be remetered.

This type of inker is particularly adapted for applying newsprint type ink in inking processes such as Di-Litho (registered trademark of American Newspaper Publishers Association/Research Institute) for printing direct on a lithographic plate with water for application on both sides of newsprint.

A primary object of the invention is to provide a non-accumulative simplified printing system which continuously provides a substantially uniform thickness of ink with a single inking form roller to opposing lithographic printing plates on each side of a newsprint web.

Another object of the invention is to provide a pair of opposing printing plates for simultaneously printing by lithography on an absorbent, porous newsprint web moving between the plates.

A still further object of the invention is to provide an inking system which continuously provides precision control of the thickness of the ink film eliminating ghosting and a resulting color variation of the printed images.

Another object of the invention is to provide an inking system to use with low viscosity ink which will provide a substantially uniform layer of ink which is readily acceptable to receiving dampening fluid for application on a printing plate.

A further object of the invention is to provide a simple and efficient inking system capable of forming a thin, continuous and substantially uniform thickness of ink which eliminates the necessity of power consuming techniques.

A still further object of the invention is to provide an inking apparatus which has a single point of control of the thickness of ink which eliminates streaks and imperfections from lint and paper fragments and color variation while minimizing lag time of adjusting the ink film.

A still further object of the invention is to provide an inking system and a dampening system, each being particularly adapted to prevent accumulation of ink and dampening fluid in the inking system and to prevent misting of ink and accumulation of lint.

Other and further objects will become apparent upon referring to the following detailed description and the attached drawings.

BRIEF DESCRIPTION OF THE DRAWINGS

Drawings of a preferred embodiment of the invention are annexed hereto so that the invention may be better and more fully understood, in which.

Numeral references are employed to designate like parts throughout the various figures of the drawing.

DESCRIPTION OF A PREFERRED EMBODIMENT

Figure 1:
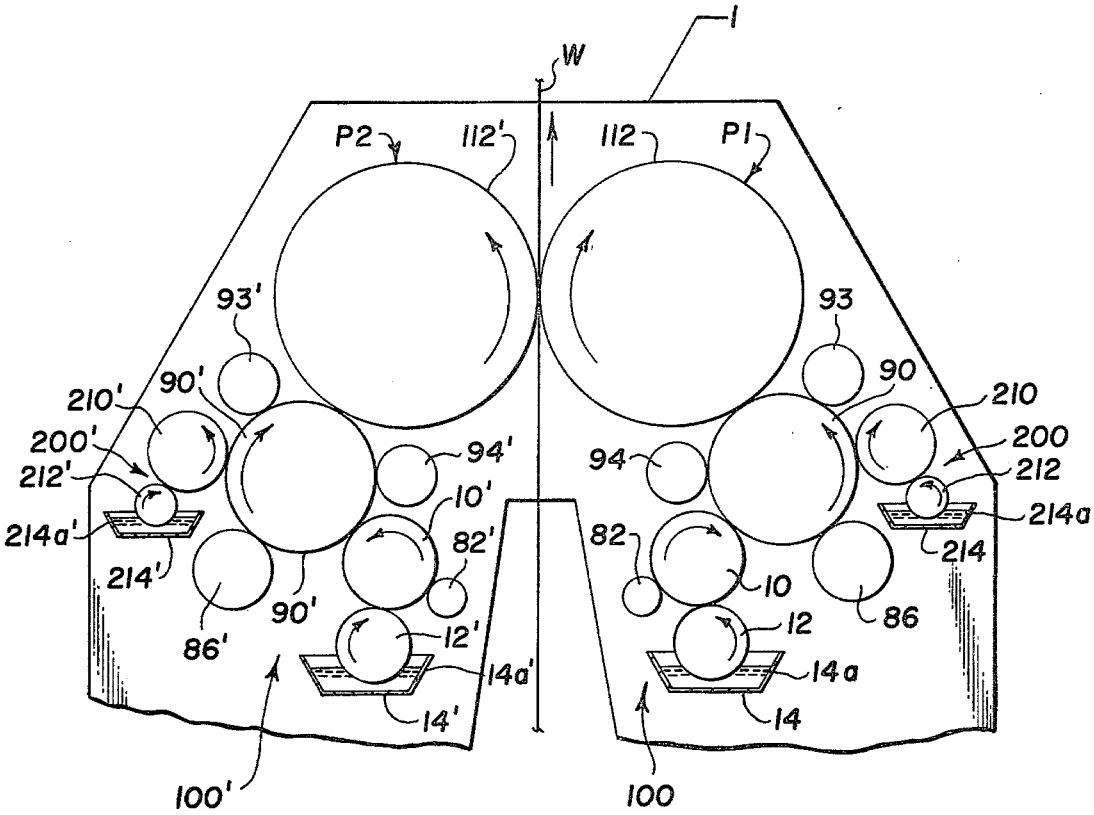
FIG. 1 is a diagrammatic illustration of the newspaper printing system.
Figure 2:
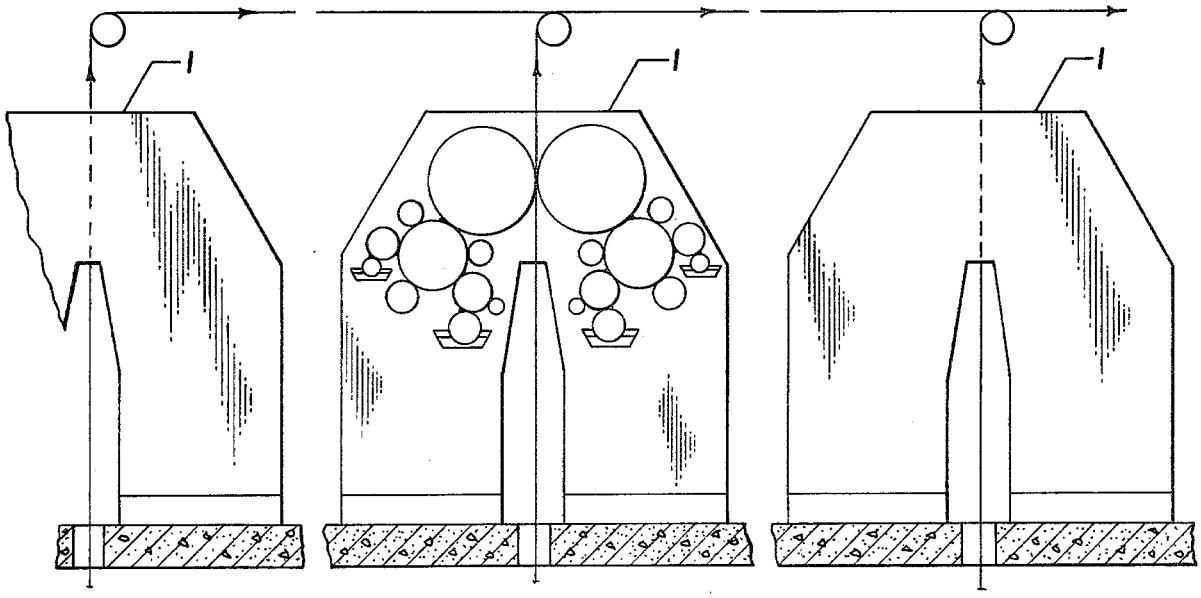
FIG. 2 is a diagrammatic illustration of a multi-unit newspaper printing system.

In FIGS. 1 and 2 of the drawing, the numeral 1 generally designates a newspaper printing system for simultaneously applying ink and dampening fluid to opposed lithographic printing plates P1 and P2 of a special simplified newsprinting press. The water applicator is a dampener 200 such as the type disclosed in U.S. Pat. No. 3,937,141, entitled "Dampener For Lithographic Printing Plates" which issued Feb. 10, 1976 to Harold P. Dahlgren. The disclosure of U.S. Pat. No. 3,937,141 is incorporated herein by reference in its entirety for all purposes. The dampener may, if expedient to do so, be of the type disclosed in my U.S. Pat. No. 3,168,037, issued Feb. 2, 1965.

The ink applicator 100 is of the type disclosed in my co-pending application Ser. No. 897,262 entitled "Inker for Applying Newsprint Type Ink", filed Apr. 18, 1978.

As illustrated in FIG. 1 inkers 100 and 100' and dampeners 200 and 200' apply ink and dampening fluid to form rollers 90 and 90' respectively which apply a water-in-ink emulsion to plates on cylinders P1 and P2, respectively, to print lithographically to each side of web W of newsprint.

Web W is a coarse sheet of porous, absorbent and resilient paper having loose fibers and uneven surfaces.

Figure 3:
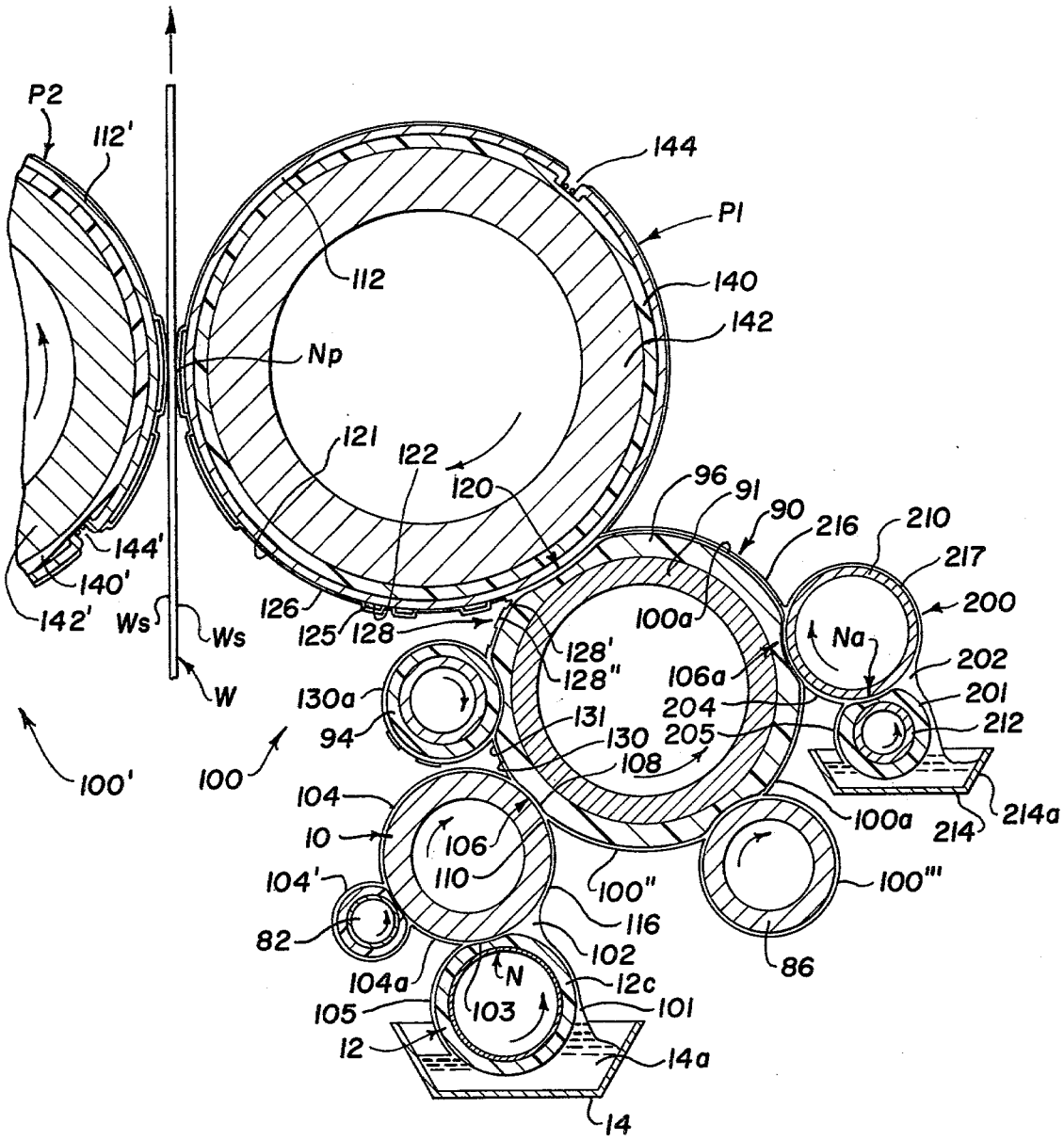
FIG. 3 is a diagrammatic illustration of the inking system illustrating the various films of ink and dampening fluid.
Figure 6:
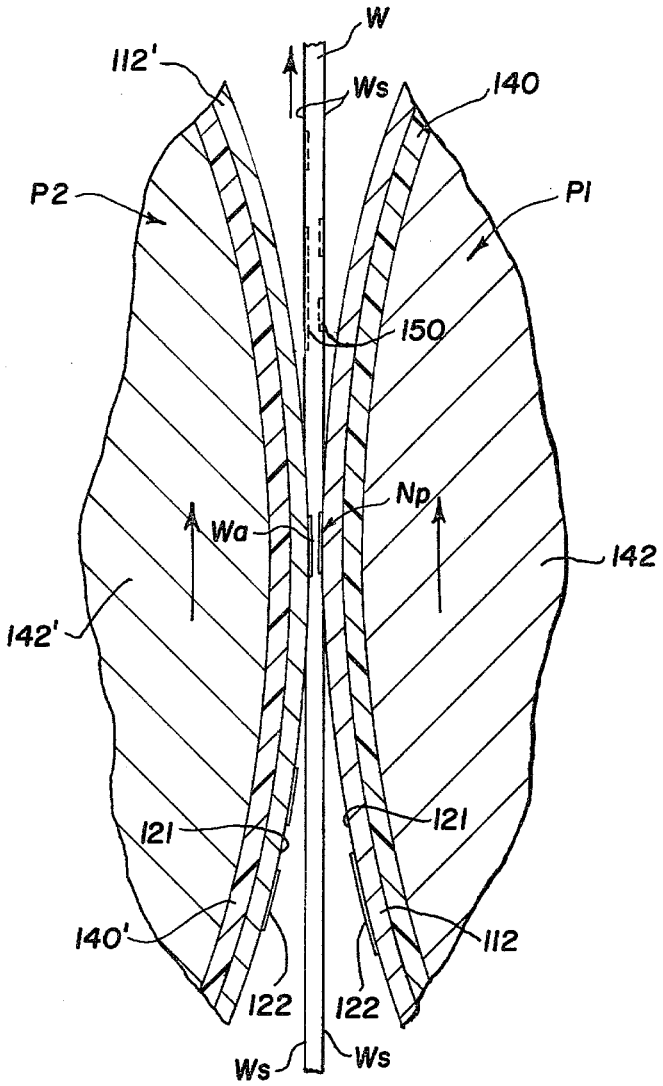
FIG. 6 is an enlarged diagrammatic view of the web engaged by the opposed plate cylinders.

Plate cylinder P1, FIGS. 3 and 6, has a resilient cover 140 secured on core 142 to support plate 112. Plate clamps 144 of typical construction are provided to secure plate 112 to cylinder P1.

Figure 4:
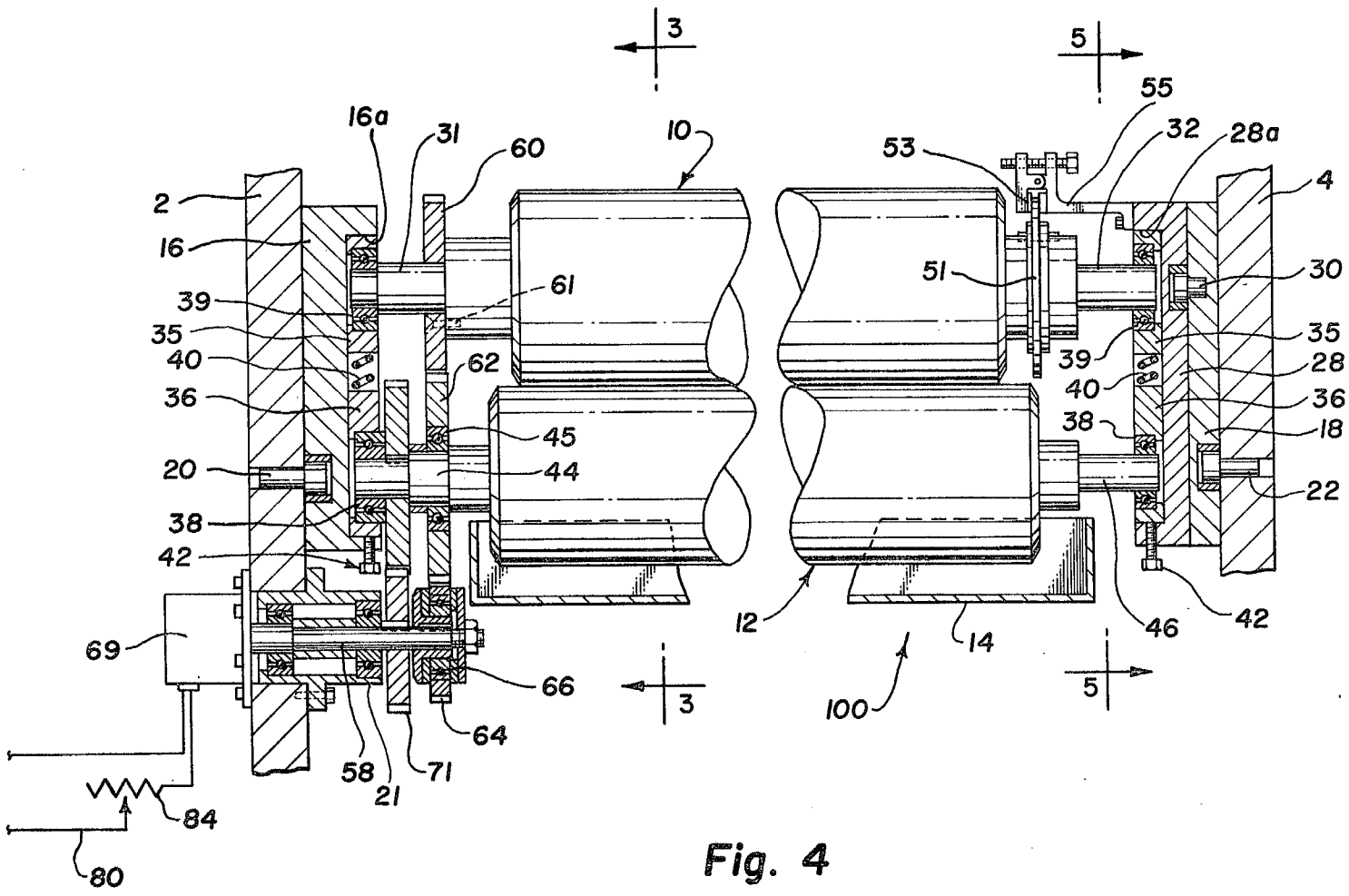
FIG. 4 is a front elevational view illustrating the ink metering and transfer rollers and support structure.

As best illustrated in FIG. 4, ink applicator 100 comprises spaced side frames 2 and 4 joined by tie bars (not shown) forming a strong rigid structure for supporting form roller 90, ink transfer roller 10, ink metering roller 12 and ink pan 14. Side frames 2 and 4 may be the side frames of the basic system or may comprise inker side frames connectable to side frames of the basic system.

Throw-off links 16 and 18 are pivotally secured by stub shafts 20 and 22 to the respective side frames 2 and 4. Throw-off cylinders 24 and 26 are pivotally connected between side frames 2 and 4 and throw-off links 16 and 18, respectively, for pivoting throw-off links 16 and 18 about stub shafts 20 and 22 for moving ink transfer cylinder 10 into position, as will be hereinafter more fully explained, for delivering ink to a single form roll in a lithographic printing system.

A skew arm 28 is mounted for pivotal movement of one end of a metering roller 12 about the axis of ink transfer roller 10. As diagrammatically illustrated in FIG. 4, skew arm 28 is rotatably secured to stub shaft 30 extending between link 18 and skew arm 28 adjacent an end of ink transfer roller 10.

Skew arm 28 and throw-off link 16 have grooves 28*a* and 16*a*, respectively, formed in the inner surfaces thereof in which blocks 36, carrying self-aligning bearings 38, are slideably disposed. Blocks 35 are rigidly secured in the upper portion of grooves 28*a* and 16*a* by screws 37 to provide suitable support for shafts 31 and 32 of the ink transfer roller 10. Suitable means such as resilient springs 40 between blocks 35 and 36 urge blocks 36 longitudinally of skew arm 28 and throw-off link 16 in a direction away from the longitudinal axis of transfer roller 10. A pressure adjustment screw 42 urges block 36 longitudinally of skew arm 28 and throw-off link 16 against the bias of springs 40. Stub shafts 44 and 46, extending outwardly from opposite ends of metering roller 12, are received in self-aligning bearings 38 to rotatably secure metering roller 12 in pressure indented relation with transfer roller 10. Stub shafts 31 and 32, extending outwardly from opposite ends of transfer roller 10, are received in bearings 39 in blocks 35.

It should be readily apparent that rotation of pressure adjustment screws 42 will move opposite ends of metering roller 12 relative to the axis of transfer roller 10 for controlling pressure between transfer roller 10 and metering roller 12.

Figure 5:
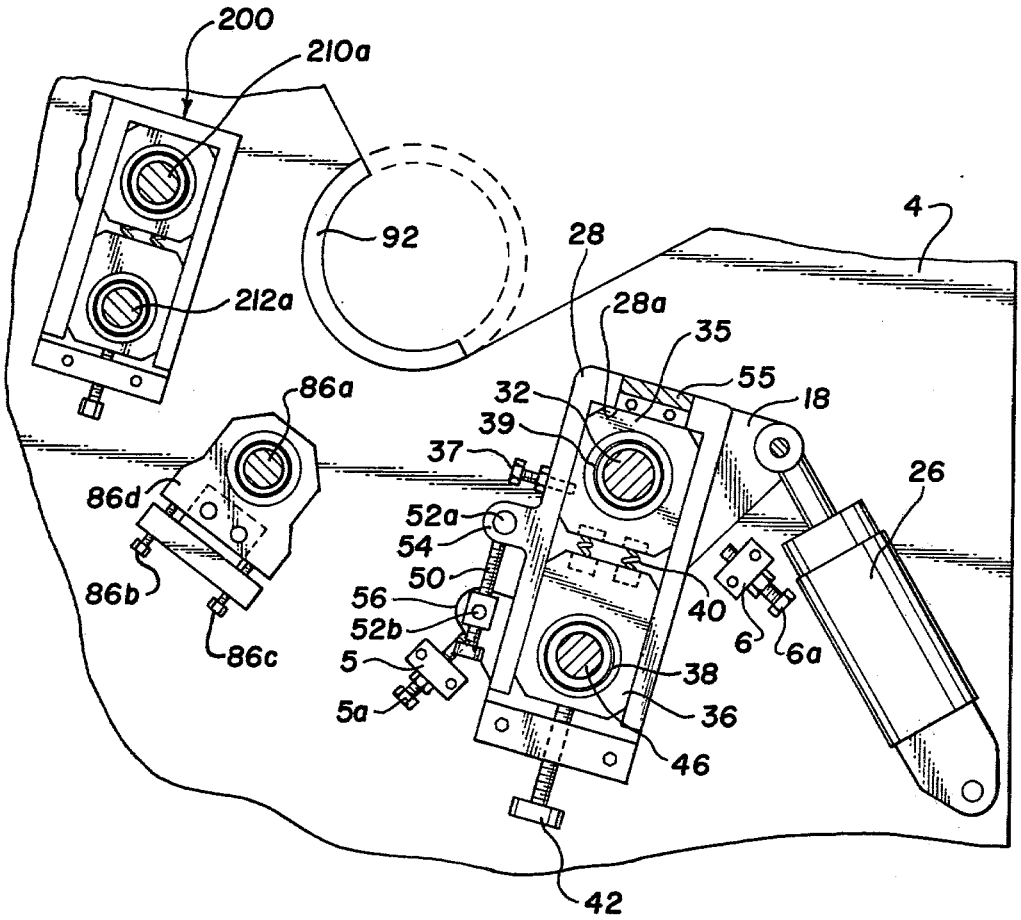
FIG. 5 is a cross sectional view taken along line 5—5 of FIG. 4.

As illustrated in FIG. 5, suitable means is provided for establishing and maintaining a desired angular relationship between throw-off link 18 and skew arm 28. In the form of the invention illustrated in FIG. 5, an adjusting screw 50 is rotatably secured to skew arm 28 and extends through threaded apertures in pivotal blocks 52*a* ansd 52*b*. Blocks 52*a* and 52*b* are pivotally secured to lug 54 on arm 28 and lug 56 on link 18. By adjusting screw 50, the spacing between lugs 54 and 56 is adjusted to move skew arm 28 relative to link 18 about shaft 30.

Side frames 2 and 4 have suitable adjustable stop means such as stop blocks 5 having set screws 5*a* extending therethrough for engaging throw-off links 16 and 18 when rods of throw-off cylinders 24 and 26 are extended for establishing a desired pressure relationship between the transfer cylinder 10 and an ink coated form roller 90 arranged to transfer ink to a lithographic plate 112 on plate cylinder P1, as will be hereinafter more fully explained. Stop means such as stop blocks 6 having set screws 6*a* secured thereto provide an off-impression limit when piston rods of throw-off cylinders 24 and 26 are retracted to move the transfer roller 10 away from the surface of form roller 90. Stub shaft 32 has a brake disc 51 secured thereto and friction pads 53 are pivotally secured to support 55 secured to arm 28 to control the speed of transfer roller 10 when it is driven by frictional engagement with form roller 90.

Stub-shaft 31, extending outwardly from the end of transfer roller 10, has a gear 60 rigidly secured thereto by screws 61 which is in meshing relation with a gear 62 rotatably secured by a bearing 45 disposed on shaft 44.

Gear 62 is secured in meshing relation with gear 64 on shaft 58 rotatably secured to housing 21 through a clutch assembly 66 of a type such as a Morse one-way clutch. Shaft 58 is secured to the shaft of a variable speed drive means such as a variable speed electric gear-motor 69. It should be appreciated that gear-motor 69 may be replaced by other drive means such as gears, sprockets, or pulleys arranged to be driven from the printing press drive, preferably through a speed-reducing gear box or similar variable speed control apparatus.

Shaft 44, extending outwardly from the end of metering roller 12, has a gear 70 secured thereto in meshing relation with a gear 71 secured to and driven by shaft 58.

Power supply line 80 is connected through a variable rheostat 84 to the terminals of motor 69 so that motor may be run at variable speeds to control the speed of rotation, and, consequently, surface speeds of transfer roller 10 and metering roller 12 independently of the press drive. If it is deemed expedient to do so motor 69 could be replaced by a variable speed coupling which connects shaft 58 to the press drive means, as hereinbefore described.

Clutch assembly 66 allows transfer roller 10 to be driven by gear-motor 69 at a minimum speed ratio relative to metering roller 12, for example 1:1, and allows transfer roller 10 to be over-driven by form roller 90 at higher speeds without driving the metering roller 12 at a faster speed which may tend to sling ink 14*a* out of pan 14.

It should be appreciated that clutch 66 can be deleted to allow drive of the transfer roller 10 positively from the gear-motor 69.

An ink storage roller 82, illustrated in FIG. 3, is preferably a vibrator or oscillator roller. Ink storage roller 82 is adapted to equalize areas of excess ink on transfer roller 10 in a manner to be more fully explained hereinafter.

Suitable means is provided for delivering an abundant supply of ink to the ink metering nip N between adjacent surfaces of transfer roller 10 and metering roller 12. In the particular embodiment of the invention illustrated in FIG. 3, a portion of the surface of metering roller 12 is submerged in ink 14*a* in ink pan 14.

Ink 14*a* preferrably comprises a low viscosity ink such as the type employed in direct lithographic printing such as newsprint type ink.

The transfer roller 10 is preferably hard and has an exterior surface which may be smooth or textured and which is ink receptive; that is, oleophillic. Ink transfer roller 10 may, therefore, have an exterior surface of materials such as copper, or plastic. The surface of transfer roller 10 may be either hard or resilient. Since form roller 90 has a resilient surface, the surface of transfer roller 10 may be hard or resilient.

Metering roller 12 preferably comprises a hollow tubular sleeve having stub shafts 44 and 46 formed thereon. A resilient cover 12*c* is shown secured about the outer surface of the sleeve. The material of metering roller cover 12*c* is selected so as to be oleophillic and the surface may be smooth or textured, hard or resilient. However, at least one of ink transfer roll 10 and metering roll 12 is made to be resilient.

To reduce the tendency of ink to accumulate adjacent the ends of transfer roller 10, metering roller 12 is longer than transfer roller 10 such that ends of the metering roller 12 extend beyond the ends of transfer roller 10. The transfer roller 10 is preferably longer than form roller 90 to minimize accumulation of excess ink adjacent ends of form roller 90.

It should be readily apparent that, if desired, the material of transfer roller 10 and metering roller 12 may be reversed such that metering roller 12 has a hard surface and transfer roller 10 has a resilient cover, or both could be resilient.

Form roller 90 is preferably cut to be the same length as the printing plate 112 or plates to also minimize accumulation of excess ink which may tend to build on the form roll if longer than the printing plate.

Referring to FIG. 3 of the drawing, transfer roller 10 is preferably positioned in pressure indented relation with a single form roller 90, having a metal tubular core 91 to the ends of which are secured stub shafts extending outwardly therefrom and rotatably journaled in bearings 92 carried by the side frames 2 and 4.

Form roller 90 has a smooth resilient outer cover 96 which may be non-absorbent or absorbent.

In one embodiment, form roller 90 may have a resilient non-absorbent surface. Another embodiment of form roller 90 includes a resilient surface and has a molleton type cover which absorbs ink and will reject dampening fluid.

An ink storage roller 94, preferably a vibrator roller, is adapted to remove ink from areas 128'' from ink film 128 on the surface of form roller 90 and add the ink to the depleted areas 128' thereby creating a more uniform film of ink on the surface of roller 90 moving from the nip 120 toward nip 108.

A material conditioning roller 86, preferably a vibrator roller, is rotatably supported on shaft **86*a* in blocks 86*d* and is adapted to condition and smooth the surface of ink film 100'' to make the film more receptive to accepting dampening fluid. Screws 86*b* and 86*c* are adapted to urge blocks 86*d* and roller 86 into pressure indented relation with form roller 90. The surface of material conditioning roller 86 is preferably of similar material to that of form roller 90 such that the surface has the same affinity for ink as does the surface of form roller 90**.

As the ink film 100'' emerges from the nip 106 between form roller 90 and transfer roll 10, it is slick, and calendared. A slick film of ink is not particularly receptive to dampening fluid since the surface tension of the molecules of ink may reject the thin layer of dampening fluid to be applied by dampener 200. Material conditioning roller 86 will receive a portion of the film 100'' of ink thus splitting the film 100'' of ink and producing a film 100''' on roller 86 thus leaving film **100*a* with a matte finish having microscopic indentations. The matte finish on film 100*a* will more readily accept the thin layer of dampening fluid 216 due to molecular attraction which is now greater than the surface tension of the dampening fluid moved into engagement therewith in film 204 on dampening fluid transfer roller 210**.

Material conditioning roller 86 and ink storage rollers 94 preferably have different diameters to eliminate repetition of a pattern such that as they rotate ink will be properly applied or extracted and redistributed on the surface of roller 90.

Vibrator rollers 82, 86 and 94 are preferably copper or plastic covered and are provided with drive means (not shown) to oscillate the rollers in a longitudinal direction. Suitable oscillator drive means is well known to persons skilled in the printing art and further description is not deemed necessary. Rotation of rollers 94 and 86 is provided through frictional contact with adjacent surfaces. Roller 82 is preferably driven by a gear in meshing relation with a gear secured to roller 10.

Dampener 200 is diagrammatically illustrated in FIGS. 3 and 5 as described in U.S. Pat. No. 3,937,141 comprises a hydrophillic transfer roller 210 on shaft **210*a* and a resilient metering roller 212 on shaft 212*a*, mounted in a similar manner to inker 100. Metering roller 212 meters dampening fluid 214*a* from pan 214 onto transfer roller 120 through flooded nip Na. Controlled pressure between adjacent surfaces of rollers 210 and 212 forms a thin layer of dampening fluid 204 which is metered through dampening fluid transfer nip 106*a* onto the matte finish of ink film 100*a* on the surface of form roller 90**.

A vibrator roller 93, not unlike rollers 94 and 86 and illustrated in FIG. 1, may be used to further smooth the inkwater film 216, if desired.

As illustrated in FIGS. 1, 3 and 6, a web W moves between resiliently supported plates on cylinders P1 and P2 carrying lithographic printing plates 112 and 112'. The structure of inking system 100' and dampener 200' supplying ink and dampening fluid to plate cylinder P2 is substantially the same as inker system 100 and dampener 200 heretofore described. Like parts of inker 100' and dampener 200' are designated by like numerals having a prime mark thereon in the drawing for descriptive purposes.

As best illustrated in FIG. 6, web W is moved through printing nip $N_p$ between plates on cylinders P1 and P2. The surfaces $W_s$ of web W are compressed in segment $W_a$ in printing nip $N_p$. Ink on image areas 122 is absorbed by the porous, absorbent web W of newsprint at printing nip $N_p$ as indicated by dashed outline of inked areas 150 past the nip $N_p$. The web W acts as a resilient absorbent blanket to allow the ink on the resiliently supported plates on cylinders P1 and P2 to be printed without significant dot gain. The absorbent web W therefore prevents mashing of dots of ink since the ink is absorbed rather than printed on the surface of the paper and later dried. The web W absorbs practically all of the ink from image areas 122.

The operation and function of the apparatus hereinbefore described is as follows:

Pressure between ends of transfer roller 10 and metering roller 12 is adjusted by rotating pressure adjustment screws 42.

Since long rollers urged together in pressure indented relation tend to deflect or bend, pressure adjacent centers of such rollers is less than pressure adjacent ends thereof. Pressure longitudinally of rollers 10 and 12 is adjusted by rotating screw 50 and rotating skew arm 28 about the axis of transfer roller 10 to a position wherein a desired pressure distribution longitudinally of rollers 10 and 12 is obtained.

Adjustment screw **5*a* is positioned to engage throw-off links 16 and 18 for establishing a desired pressure between transfer roller 10 and form roller 90**.

The relative surface speeds of rollers 10 and 12 and of rollers 10 and 90 can be regulated by manipulating rheostat 84 as has been hereinbefore explained.

Dampener 200 is adjusted in a similar manner as inker 100 for applying dampening fluid to form roller 90.

For the purpose of graphically illustrating the novel function and results of the process of the mechanism hereinbefore illustrated and described, a diagrammatic view of the metering roller 12, the transfer roller 10 and the form roller 90 is shown in FIG. 3. Ink and water films shown are exaggerated for clarity.

As shown in FIG. 3, metering roller 12, when employed to deliver ink to a printing plate 112 on print cylinder P1 is preferably a resilient surfaced roller having a smooth surface 12c thereon and has the lower side thereof immersed in ink 14a in pan 14. The metering roller 12 is rotatably mounted in pressure indented relation with transfer roller 10, and the pressure between adjacent roller surfaces is adjusted by screws 42 and 50, as hereinbefore described, so that the surface of transfer roller 10 is actually impressed into the surface of roller 12 at ink metering nip N.

As the surface of roller 12 rotates toward the ink metering nip N between rollers 10 and 12, a relatively heavy layer 101 of ink is picked up and lifted on the surface of roller 12. At the point of tangency, or cusp area at the ink metering nip N, between the rollers 10 and 12, a bead 102 of ink is piled up forming an excess of ink. The greatness of the excess of ink forming bead 102 is regulated by virtue of the fact that excessive ink will fall back into the pan 14 by gravity, thus, virtually creating a waterfall of ink, and by the surface speed of metering roller 12. The bead 102 becomes a reservoir from which ink is drawn by transfer roller 10. As rollers 10 and 12 rotate in pressure indented relation, a layer of ink is sheared and/or metered between adjacent surfaces of the two rollers separated by a thin lubricating layer of ink 103. Since the transfer roller 10 has a smooth, oleophillic surface thereon, a portion of the film 103 adheres to the surface of roller 10 to form a quantity 104a, the remaining portion 105 thereof being rotated back or fed-back in the pan 14. The quantity of ink 104a is distributed on the surface of roller 10 by reason of the rotating, squeezing action between rollers 10 and 12 at their tangent point at ink metering nip N. Ink storage roller 82 splits ink 104a and receives ink 104' which is added to ink 104a again to further assure smooth uniform thickness of ink 104 on transfer roller 10.

The film of ink 104 rides on the surface of roller 10 and comes in contact with the film 130 of ink on form roller 90 at the tangent point or ink transfer nip 106 between transfer roller 10 and form roller 90.

At ink transfer nip 106, it will be observed that transfer roller 10 is impressed into the resilient surface of form roller 90 and that the film of ink 104 has an outer surface 108, contacting the ink film 130, and an inner surface 110 adhering to the surface of roller 10. The outer surface 108 of film 104 and the outer surface 131 of the film of ink 130 on form roller 90 are urged together to create a hydraulic connection between rollers 10 and 90 as they rotate in close relationship, but there is no physical contact between the adjacent roller surfaces.

It is an important fact to note that the relatively thick quantity of ink 104 requires rollers 10 and 90 to be rotated at different surface speeds, as will be hereinafter explained. Preferably, the form roller 90, which is normally rotated at the same surface speed as the printing plate 112 on cylinder P1, and press driven, is rotated at a surface speed greater than the surface speed of roller 10. By regulating the differential surface speed between transfer roller 10 and applicator roller 90 the amount of ink applied to the plate 112 may be regulated.

Within limits, as will be hereinafter more fully explained, if the surface speed of transfer roller 10 is increased the ink film 104 is presented at the ink transfer nip 106 at a faster rate and more ink is transferred to the surface of roller 90 and to lithographic printing plate 112 on cylinder P1, and the opposite is true, if the surface speed of ink transfer roller 10 is decreased.

The film of ink, existent between adjacent surfaces of rollers 10 and 90, permits rollers 10 and 90 to be rotated at different surface speeds in sliding relationship, because the film of ink actually provides lubrication which permits slippage between adjacent surfaces of rollers 10 and 90 without frictional deterioration. By reason of the slippage between rollers 10 and 90, the ink 104 is calendared, smoothed out, metered and distributed by shearing ink 104 between adjacent surfaces of roller 10 and the ink film 130 on form roller 90, to create ink film 100''. The thickness of ink film 100'' is controlled by pressure between metering roller 12 and transfer roller 10 and the speed of transfer roller 10.

Transfer roller 10 preferably is driven at a surface speed which is within a range of for example, several hundred feet per minute slower than the surface speed of form roller 90. For example, if a printing press has paper travelling therethrough at a surface speed of 1200 feet per minute the surfaces of printing plate 112 and form roller 90 will ordinarily have surface speeds of 1200 feet per minute. The surface speed of transfer roller 10 may however rotate at a surface speed in a range between 50 feet per minute and 100 feet per minute to create adequate film 100'' for printing.

Ink 104 and film 130 are combined at ink transfer nip 106 and will split when sheared as rollers 10 and 90 rotate away from ink transfer nip 106. The fresh film 100'' of ink adheres to the surface of form roller 90. Ink rejected by form roller 90 forms a feedback film 116 of ink which adheres to the surface of the transfer roller 10 and is conveyed back to the bead 102 of ink adjacent ink metering nip N to be remetered. Feedback film 116 is not necessarily uniform because the starved areas 128' on form roller 90, from which ink was removed by image areas on the plate 122, removed different quantities of ink from ink quantity 104 in order to remeter film 128 on form roller 90. Film 128 has starved areas 128' from ink removed by image areas 122 on plate 112, thus rendering film 128 irregular.

As the film 100'' of ink on the surface of form roller 90 moves from ink metering nip 106 adjacent transfer roller 10, the film 100'' is substantially uniform as non-uniform film 130 is combined with ink quantity 104 carried on transfer roller 10. Film 130 accepts ink from film 104 in the starved or depleted areas 128'. The transfer roller 10 is caused to rotate at a speed which satisfies the need for ink by form roller 90 by overriding clutch 66 and brake 55. The depleted portion or feedback film 116 is returned to the abundant or excess supply of ink at bead 102 between metering roller 12 and transfer roller 10 to replenish the ink quantity.

It has already been explained that the ink film 130 is smoothed out, distributed, metered, and regulated at the ink transfer nip 106 between transfer roller 10 and form roller 90. Material conditioning roller 86 splits film 100'', taking on a film 100''' to produce a matte finish on ink film 100a. Any irregularities or streaks in film 100'' will be spread and equalized to form film 100a of very uniform thickness.

The interfacial tension between the outer surface of the less viscous damping fluid film 204, by reason of molecular attraction between the surface of the more viscous ink film 100a, causes a portion 216 of the smooth and regulated film 204 of dampening fluid to be added to the surface of ink film 100a, which in turn is transferred to the plate at the tangent point between the plate 112 and form roller 90 at inking nip 120.

The lithographic printing plate 112 has hydrophillic, or water liking, non-image areas 121 and oleophillic, or ink receptive, image areas 122 formed on the surface thereof.

At the nip 120 between applicator roller 90 and printing plate 112 on cylinder P1, the ink-water emulsion 216 is split, forming thin films 125 of ink and water over oleophillic surfaces 122 on the printing plate. The layer 216 of dampening fluid and ink is carried on and in the film 100*a* of ink and is also distributed to form a thin film 126 of dampening fluid over hydrophillic areas 121 of the printing plate.

No appreciable amount of dampening fluid remains on the surface of form roller 90 which is moving away from the nip 120, but such dampening fluid as does remain thereon is transferred with the ink film 128 to the ink film 130*a* on the ink storage roller 94 where the dampening fluid can be distributed and dissipated and/or evaporated to such an extent as to be of no consequence in the inking system. Without roller 94, water and ink variations cause poor distribution of ink quantity 104 to be applied to form roller 90; that is, depleted areas tend to remain depleted.

Ink film 128 remaining on form roller 90 is combined with film 130*a* on ink storage roller 94 and split and collected on roller 94. Ink on roller 94 is added to depleted areas 128' in film 128 thus reducing the effect of ghosted areas in film 128 by forming a more uniform film 130 before re-entering nip 106.

The dampening fluid 216 is applied in substantially the same manner. An excess of dampening fluid 201 is supplied to form bead 202 to form a metered film 204 of dampening fluid which is applied to ink film 100*a* on form roller 90 at nip 106*a* forming a water-in-ink emulsion 216. The remaining film 217 of dampening fluid is returned to bead 202 to be re-metered at nip Na.

From the foregoing it should be readily apparent that the improved apparatus for applying ink to opposed printing plates offers control of metering at ink metering nip N to provide a film 104 of ink of precisely controlled thickness by adjusting pressure between transfer roller 10 and metering roller 12 and further by controlling surface speeds of rollers 10 and 90 relative to each other. The rate at which the metered film 104 of ink is offered to film 130 of ink on form roller 90 at ink transfer nip N and also the hydraulic force for obtaining the desired film split is controlled.

To eliminate conditions which could cause accumulation of ink rendering it impossible to form a quantity of ink 104 of precisely controlled thickness the specific roller arrangement provides for replenishment of ink which is fed-back in the form of ink film 116 on transfer roller 10 moving away from the ink transfer nip 106. Thus, the effect of the unused depleted film of ink not accepted by printing plate 112 is eliminated from the inking system by returning film 116 to the flooded ink metering nip N and is not left to accumulate on transfer roller 10 as in prior art devices.

It should further be appreciated that either the transfer roller 10 or metering roller 12 could be geared to the press drive, or driven by an independent drive means, for establishing the conditions hereinbefore described for a specified speed range.

It should be appreciated that transfer roller 10 may be oscillated laterally along its axis to further smooth ink films 130 and 100''.

Inker 100' and dampener 200' supply ink and dampening fluid to plate 112' on cylinder P2 in a similar manner as described heretofore for plate cylinder P1.

It should be appreciated that under certain operating conditions metering roller 12 could be replaced by a stationary non-rotating metering member to meter ink on ink transfer roller 10 where an excess supply of ink is supplied to the transfer roller.

It should be readily apparent that the heretofore described invention provides a simplified plate to plate printer with continuous duty inkers and dampeners to produce an improved image on newsprint type paper.

While the printing system hereinbefore described is particularly adapted for printing ink of low viscosity onto rough, porous paper known as newsprint; it should be readily apparent that different types of ink and paper may be employed with the system without departing from the basic concept of the invention. Further, the resilient packing under one or both of the printing plates may be omitted, if it is deemed expedient to do so, to achieve a desired paper pressure.

While a preferred embodiment of the invention has been hereinbefore described and illustrated in the attached drawings it should be appreciated that other and further forms of the apparatus can be devised without departing from the basic concept thereof.

Having described my invention, I claim:

1. A printing system wherein low viscosity ink and dampening fluid are applied to opposing lithographic printing plates which simultaneously engage opposite sides of a web, the improvement comprising: support means; first and second plate cylinders; a lithographic printing plate on each of said plate cylinders; means rotatably securing said plate cylinders to said support means such that said lithographic printing plates engage opposite sides of a web moving between said plate cylinders; first and second form rollers; means urging said first and second form rollers into pressure indented relation with said first and second lithographic printing plates; first and second inkers and dampeners arranged to continuously apply a metered film of ink and dampening fluid over said first and second form rollers directly to said lithographic printing plates, each of said inkers comprising: an ink metering means; an ink transfer roller having an oleophillic ink receptive surface urged into pressure relation with a respective one of said form rollers to form an ink transfer nip; means supporting said ink metering means and said ink transfer roller to maintain a pressure relationship therebetween to form an ink metering nip between adjacent surfaces of the ink metering means and the ink transfer roller; means to supply ink to said ink transfer roller such that the ink metering means produces a continuous quantity of ink on the surface of said ink transfer roller; speed control means to control the surface speed of said ink transfer roller relative to the surface speed of a respective one of said form rollers to control the thickness of a newly metered film of ink on a respective one of said form rollers; an ink storage roller supported in rotative contact with the surface of the film of ink on a respective one of said form rollers which has just moved from the printing plate and prior to the ink transfer nip, said ink storage roller being adapted to substantially equalize the surface of the irregular film of ink; and each of said dampeners comprising: a hydrophilic dampening fluid transfer roller adapted to apply a uniform film of dampening fluid to the surface of the newly metered film of ink on the surface of a respective one of said form rollers; means rotatably supporting said hydrophilic dampening fluid transfer roller in pressure indented relationship with a respective one of said form rollers; dampening fluid metering means; and means to supply dampening fluid to said hydrophilic dampening fluid transfer roller such that the dampening fluid metering means produces a smooth, uniform, continuous film of dampening fluid on the surface of the hydrophilic dampening fluid transfer roller.

2. A printing system according to claim 1 wherein the dampening fluid metering means comprises a metering roller and means urging said metering roller into pressure indented relationship with said hydrophilic dampening fluid transfer roller.

3. A printing system according to claim 1 wherein said speed control means comprises: a brake and drive means operably secured to said ink transfer roller and adapted to drive said ink transfer roller at a slower surface speed than the surface speed of a respective one of said form rollers.

4. A printing system according to claim 3, wherein said drive means comprises: a variable speed drive means.

5. A printing system according to claim 1 with the addition of: a material conditioning roller supported in rotative contact with the newly metered film of ink on the surface of a respective one of said form rollers, said material conditioning roller being adapted to produce a matte finish on said film of ink.

6. A printing system according to claim 1 wherein said ink metering means comprises: an ink metering roller having an oleophillic surface formed thereon; means urging said oleophillic roller into pressure indented relationship with said ink transfer roller and means to rotate the roller.

7. A printing system according to claim 1, said speed control means comprising: a brake associated with said ink transfer roller to maintain the surface speed of the ink transfer roller less than the surface speed of a respective one of said form rollers.

8. A printing system according to claim 1 wherein each of said form rollers has a resilient non-absorbent surface formed thereon.

9. A printing system according to claim 1 wherein each of said form rollers has a resilient absorbent surface formed thereon.

10. A printing system according to claim 1 with the addition of: means to replenish ink on the surface of the ink transfer roller which is moving from the ink transfer nip to said ink metering nip.

11. A printing system wherein first and second lithographic printing plates are urged into pressure relation with opposite sides of a web moving between the printing plates, the improvements comprising: a resilient surfaced form roller in pressure relation with each lithographic printing plate to form a first nip; an ink transfer roller having an ink receptive surface urged into pressure indented relation with said form roller to form an ink transfer nip; a vibrator roller having an ink receptive surface urged into pressure indented relation with a portion of the surface of said form roller which is moving from said first nip toward said ink transfer nip; means applying ink to the surface of the ink transfer roller; brake means to adjust the surface speed of the ink transfer roller relative to the surface speed of the form roller to control the amount of ink carried by the form roller from the ink transfer nip to said first nip; and dampener means applying dampening fluid to ink on said form roller.

12. A printing system wherein low viscosity ink and dampening fluid are applied to opposing lithographic printing plates which simultaneously engage opposite sides of a web, the improvement comprising: support means; first and second plate cylinders; a lithographic printing plate on each of said plate cylinders; means rotatably securing said plate cylinders to said support means such that said lithographic printing plates engage opposite sides of a web moving between said plate cylinders; first and second form rollers; means urging said first and second form rollers into pressure indented relation with said first and second lithographic printing plates; first and second inkers and dampeners arranged to continuously apply a metered film of ink and dampening fluid over said first and second form rollers directly to said lithographic printing plates, each of said inkers comprising: an ink metering means; an ink transfer roller having an oleophillic ink receptive surface urged into pressure relation with a respective one of said form rollers to form an ink transfer nip; means supporting said ink metering means and said ink transfer roller to maintain a pressure relationship therebetween to form an ink metering nip between adjacent surfaces of the ink metering means and the ink transfer roller; means to supply ink to said ink transfer roller such that the ink metering means produces a continuous quantity of ink on the surface of said ink transfer roller; an ink storage roller having an oleophillic surface; means supporting said ink storage roller in pressure relation with said ink transfer roller, said ink storage roller adapted to remove excess ink and smooth and replenish the excess ink on the surface of the ink transfer roller prior to the ink film moving to a respective one of said form rollers; speed control means to control the surface speed of said ink transfer roller relative to the surface speed of a respective one of said form rollers to control the thickness of a newly metered film of ink on a respective one of said form rollers; and each of said dampeners comprising: a hydrophilic dampening fluid transfer roller adapted to apply a uniform film of dampening fluid to the surface of the newly metered film of ink on the surface of a respective one of said form rollers; means rotatably supporting said hydrophilic dampening fluid transfer roller in pressure indented relationship with a respective one of said form rollers; dampening fluid metering means; and mean to supply dampening fluid to said hydrophilic dampening fluid transfer roller such that the dampening fluid metering means produces a smooth, uniform, continuous film of dampening fluid on the surface of the hydrophilic dampening fluid transfer roller.

13. A printing system wherein low viscosity ink and dampening fluid are applied to opposing lithographic printing plates which simultaneously engage opposite sides of a web, the improvement comprising: support means; first and second plate cylinders; a lithographic printing plate on each of said plate cylinders; means rotatably securing said plate cylinders to said support means such that said lithographic printing plates engage opposite sides of a web moving between said plate cylinders; first and second form rollers; means urging said first and second form rollers into pressure indented relation with said first and second lithographic printing plates; first and second inkers and dampeners arranged to continuously apply a metered film of ink and dampening fluid over said first and second form rollers directly to said lithographic printing plates; an ink vibrator roller supported in rotative contact with the surface of the film of ink and dampening fluid on each of said form rollers, said ink vibrator roller being adapted to substantially equalize the surface of the film of ink and dampening fluid, each of said inkers comprising: an ink metering means; an ink transfer roller having an oleophillic ink receptive surface urged into pressure relation with a respective one of said form rollers to form an ink transfer nip; means supporting said ink metering means and said ink transfer roller to maintain a pressure relationship therebetween to form an ink metering nip between adjacent surfaces of the ink metering means and the ink transfer roller; means to supply ink to said ink transfer roller such that the ink metering means produces a continuous quantity of ink on the surface of said ink transfer roller; speed control means to control the surface speed of said ink transfer roller relative to the surface speed of a respective one of said form rollers to control the thickness of a newly metered film of ink on a respective one of said form rollers; and each of said dampeners comprising: a hydrophilic dampening fluid transfer roller adapted to apply a uniform film of dampening fluid to the surface of the newly metered film of ink on the surface of a respective one of said form rollers; means rotatably supporting said hydrophilic dampening fluid transfer roller in pressure indented relationship with a respective one of said form rollers; dampening fluid metering means; and means to supply dampening fluid to said hydrophilic dampening fluid transfer roller such that the dampening fluid metering means produces a smooth, uniform, continuous film of dampening fluid on the surface of the hydrophilic dampening fluid transfer roller.

* * * * *